US006668479B1

(12) United States Patent
Obong

(10) Patent No.: US 6,668,479 B1
(45) Date of Patent: Dec. 30, 2003

(54) FIREARM MAGAZINE HOLDER

(76) Inventor: Roberto V. Obong, P.O. Box 70096, Pasadena, CA (US) 91117-7096

( * ) Notice: Subject to any disclaimer, the term of this patent is extended or adjusted under 35 U.S.C. 154(b) by 0 days.

(21) Appl. No.: 10/359,829

(22) Filed: Feb. 7, 2003

Related U.S. Application Data

(63) Continuation-in-part of application No. 10/177,616, filed on Jun. 19, 2002.

(51) Int. Cl.[7] ..... F41C 27/00
(52) U.S. Cl. ..... 42/90; 206/3
(58) Field of Search ..... 42/90, 106; 206/3; 220/555, 553

(56) References Cited

U.S. PATENT DOCUMENTS

| | | | | | |
|---|---|---|---|---|---|
| 1,656,072 | A | * | 1/1928 | Lukens | 220/771 |
| 3,394,861 | A | * | 7/1968 | Truax | 229/120.07 |
| 3,521,808 | A | * | 7/1970 | Weiss | 206/564 |
| 3,703,955 | A | * | 11/1972 | Inacker | 206/532 |
| 3,769,733 | A | | 11/1973 | Nelson | 42/89 |
| 3,782,582 | A | * | 1/1974 | Lybbert et al. | 220/23.6 |
| 3,880,389 | A | | 4/1975 | Burris | 248/205.1 |
| 3,976,193 | A | * | 8/1976 | Dogliotti | 206/558 |
| 4,034,885 | A | * | 7/1977 | Hunckler et al. | 220/524 |
| 4,053,054 | A | * | 10/1977 | Lucas | 206/534 |
| 4,115,943 | A | | 9/1978 | Musgrave | 42/90 |
| 4,299,044 | A | | 11/1981 | Johannsen | 42/127 |
| 4,343,400 | A | * | 8/1982 | Faucillon | 206/507 |
| 4,447,976 | A | | 5/1984 | Cooper | 42/49 |
| 4,484,403 | A | | 11/1984 | Schwaller | 42/50 |
| 4,484,404 | A | | 11/1984 | Johnson | 42/90 |
| 4,685,238 | A | | 8/1987 | Schoepflin | 42/90 |
| 5,131,559 | A | * | 7/1992 | Ariyoshi et al. | 220/555 |
| 5,174,482 | A | | 12/1992 | Rogers et al. | 224/239 |
| 5,279,059 | A | | 1/1994 | Howard | 42/90 |
| 5,636,465 | A | | 6/1997 | Johnson | 42/90 |
| 5,676,241 | A | * | 10/1997 | Degoix et al. | 206/3 |
| 6,050,464 | A | | 4/2000 | Ramsey et al. | 224/196 |
| 6,202,908 | B1 | | 3/2001 | Groover | 224/239 |
| 6,250,198 | B1 | | 6/2001 | Vendetti et al. | 89/44.02 |
| 6,289,782 | B1 | | 9/2001 | Watson | 89/37.01 |
| 6,435,976 | B1 | | 8/2002 | Galliers | 473/244 |
| 6,499,245 | B1 | | 12/2002 | Swan | 42/71.01 |

OTHER PUBLICATIONS

*Defense Procurement Manufacturing Services, Inc.* (DPMS), Website pages (4) from website with homepage at http://www.dpmsinc.com, May 22, 2002.

*Buffer Technologies*, Website pages (3) from website with homepage at http://www.buffertech.com, May 22, 2002.

*Defense Procurement Manufacturing Services, Inc.* (DPMS), Website page from website with homepage at http://www.shooterstore.com, with illustration of "Side–By–Side A–15 Magazine Holder", Dec. 5, 2002.

* cited by examiner

*Primary Examiner*—Michael J. Carone
*Assistant Examiner*—Denise J Buckley
(74) *Attorney, Agent, or Firm*—Cohen & Sakaguchi LLP

(57) ABSTRACT

A device for holding a plurality of firearm magazines is disclosed. The device includes a single-piece body having a first compartment adapted to receive a first magazine, and a second compartment adapted to receive a second magazine. The first and second compartments are separated by a divider. The device also optionally includes a first securing member located within a first housing of the divider, and a second securing member located within a second housing of the divider. The first securing member is adapted to engage the first magazine when the first magazine is seated in the first compartment, typically by engaging a groove of the first magazine. Similarly, the second securing member is adapted to engage the second magazine when the second magazine is seated in the second compartment, typically by engaging a groove of the second magazine.

23 Claims, 11 Drawing Sheets

FIREARM MAGAZINE HOLDER

This application is a continuation-in-part of U.S. patent application Ser. No. 10/177,616, filed on Jun. 19, 2002. Priority to the aforementioned application is hereby expressly claimed in accordance with 35 U.S.C. §120 and any other applicable statutes.

The contents of the aforementioned application, and of each U.S. Patent and other reference, if any, cited in this application, are hereby incorporated herein by reference.

FIELD OF INVENTION

The present invention relates generally to a firearm magazine or clip. More particularly the present invention relates to a device for holding or joining a plurality of firearm magazines or clips that enable accessibility to a plurality of ammunition.

BACKGROUND OF INVENTION

Many modern firearms used for combat or sporting activities are capable of high cyclic rates of fire and are usually equipped with magazines capable of holding a plurality of cartridges. Such magazines must usually be manually released from the weapon when they have become empty, at which time a second magazine must be inserted into the weapon before firing may be continued. Typically, the second or third magazine is carried in a protective pouch attached to the weapon user's belt or carried in the user's vest or pocket. Since removal and insertion of the additionally loaded magazine may take an undesirably long time, various devices have been developed in an effort to expedite and ease the loading of the additional magazine.

Generally, multiple magazine holders serve the purpose of coupling together two or more magazines so that the combatant or sportsman will have immediately available multiple magazines rather than one magazine for use with the weapon. Such holders have previously welded or taped magazines together in an effort to provide an ability to fire more rounds quickly. Alternatively, a clip joining device for holding two clips end to end (see, e.g., U.S. Pat. No. 4,685,238, issued Aug. 11, 1987 to Schoepflin), or a box-like protective device attachable to the weapon (see, e.g., U.S. Pat. No. 4,484,404, issued Nov. 24, 1984 to Johnson), are known. Another magazine holder, distributed by Defense Procurement Manufacturing Services, Inc. (DPMS) and advertised on May 22, 2002 at the DPMS website http://www.dpmsinc.com, discloses a "Triple Mag Holder". Although generally well-suited for holding multiple magazines, the DPMS device presents potential problems for the user regarding safety and ease of placing and securing multiple magazines. DPMS has also advertised a "Side-By-Side A-15 Magazine Holder" on Dec. 5, 2002 at http://www.shootstore.com. The "Side-By-Side A-15 Magazine Holder" also presents potential problems for the user regarding safety and ease of placing and securing multiple magazines.

Accordingly, there is a need for a device capable of holding a plurality of firearm magazines that is more efficient, safer, highly effective, and more reliable than known devices.

SUMMARY

The present invention describes a device capable of holding a plurality of firearm magazines that is more efficient, safer, highly effective, and more reliable than known devices. One embodiment of the device comprises an upper plate, a lower plate, and an interconnected securing member. The upper plate is rotationally positioned about the securing member, and the lower plate is rotationally mounted to the securing member below the upper plate. Magazines are placed between the upper plate and the lower plate in slots defined by the inner surfaces of the plates, and together the plates securely engage the magazines in a clamp-like manner when tightened with the securing member.

Multidirectional movements of the plates allow them to be adjusted in order to facilitate placement and securing of the magazines. Adjustment of the upper plate includes free/unrestricted rotational movement about the central longitudinal axis of the securing member, and restricted vertical translational movement about the central longitudinal axis of the securing member. Adjustment of the lower plate includes rotational movement about the central longitudinal axis of the securing member. The upper plate has an inner lip within a recess, allowing the securing member head to be contained substantially within the recess and/or rest substantially flush with the outer surface of the upper plate when in use. Additionally, the upper plate and the lower plate have substantially curved edge surfaces, providing a smooth transition from one surface to another.

Thus, one embodiment of the present invention includes a device for holding two magazines for use with a firearm comprising: an upper plate having an outer surface and an inner surface; a lower plate having an outer surface and an inner surface; and a securing member having a head, a body, and a foot, said head having a top surface and a bottom surface; wherein the upper plate is rotationally positioned about the body of the securing member; the lower plate is rotationally mounted to the foot of the securing member; the upper plate has a recess with an aperture, and the securing member foot and the securing member body pass through the recess and aperture of the upper plate, the securing member head being received in the recess such that the bottom surface of the securing member head engages an inner lip of the recess thus preventing the securing member head from passing through the aperture of the upper plate, the depth of the recess and the height of the securing member head being such that the top surface of the securing member head is contained substantially within the recess; the lower plate receives the securing member foot in a threaded aperture; and the inner surface of the upper plate defines first and second slots adapted to engage top surfaces of first and second firearm magazines respectively, and the inner surface of the lower plate defines corresponding first and second slots adapted to engage bottom surfaces of the first and the second firearm magazines respectively, such that together the upper plate and the lower plate securely receive the first and the second firearm magazines in the first and second slots respectively, upon tightening of the device.

The device may be used by: separating the upper plate from the lower plate a sufficient distance to allow a plurality of firearm magazines to be positioned therebetween; adjusting the upper plate and the lower plate to facilitate placement of the plurality of magazines therebetween, including rotating the lower plate at least five degrees about a central longitudinal axis of the securing member, rotating the upper plate at least five degrees about the central longitudinal axis, and vertically translating the upper plate about the central longitudinal axis; placing a plurality of magazines between the upper plate and the lower plate; and tightening the securing member to secure the plurality of magazines between the upper plate and the lower plate, and to position the securing member head to be substantially contained within the recess of the upper plate.

The multidirectional movement of the upper plate and lower plate, substantially curved edge surfaces and/or chamfered outer edge surfaces, recessed securing member head, and other structural elements provide for a device capable of holding a plurality of firearm magazines that is more efficient, safer, highly effective, and more reliable than known devices.

Another embodiment of the present invention is a device comprising a single-piece body having a first compartment adapted to receive a first magazine, and a second compartment adapted to receive a second magazine. The first compartment and the second compartment are separated by a divider. Optionally, the magazine holder further comprises a first securing member located within a first housing of the divider, and a second securing member located within a second housing of the divider. The first securing member is adapted to engage the first magazine when the first magazine is seated in the first compartment. Similarly, the second securing member is adapted to engage the second magazine when the second magazine is seated in the second compartment.

The single-piece body optionally has maintenance holes to allow access to the first and/or second securing members through the first and second compartments respectively, and which are sized to allow the first and second securing members respectively to pass therethrough. The body may also have at least one irrigation hole in the bottom surface thereof. Also optionally, at least a portion of the single-piece body may have an anti-slip surface.

The embodiment with a single-piece body may be used by: seating a first magazine in the first compartment such that the first securing member engages the first magazine to secure the first magazine into the first compartment; and seating a second magazine in the second compartment such that the second securing member engages the second magazine to secure the second magazine into the second compartment.

The single-piece body, with the first and second securing members as described herein, and other structural elements of this embodiment of the present invention, also provide for a device capable of holding a plurality of firearm magazines that is more efficient, safer, highly effective, and more reliable than known devices.

DETAILED DESCRIPTION

The present invention describes a device for holding a plurality of firearm magazines that is more efficient, safer, highly effective, and more reliable than known devices. The device comprises an upper plate, a lower plate, and a securing member. The upper plate is rotationally positioned about the securing member, and the lower plate is rotationally mounted to the securing member below the upper plate. Magazines are placed between the upper plate and the lower plate, which together securely engage the magazines when tightened with the securing member. Multidirectional movements of the plates allow them to be adjusted in order to facilitate placement and securing of the magazines. Adjustment of the upper plate includes free/unrestricted rotational movement about the central longitudinal axis of the securing member, and restricted vertical translational movement about the central longitudinal axis of the securing member. Adjustment of the lower plate includes rotational movement about the central longitudinal axis of the securing member. A recessed inner lip of the upper plate (allowing the head of the securing member to rest within and/or substantially flush with the outer surface of the upper plate) and substantially curved edges, reduce the potential for personal injury due to sharp and/or protruding surfaces.

Figure 2A:
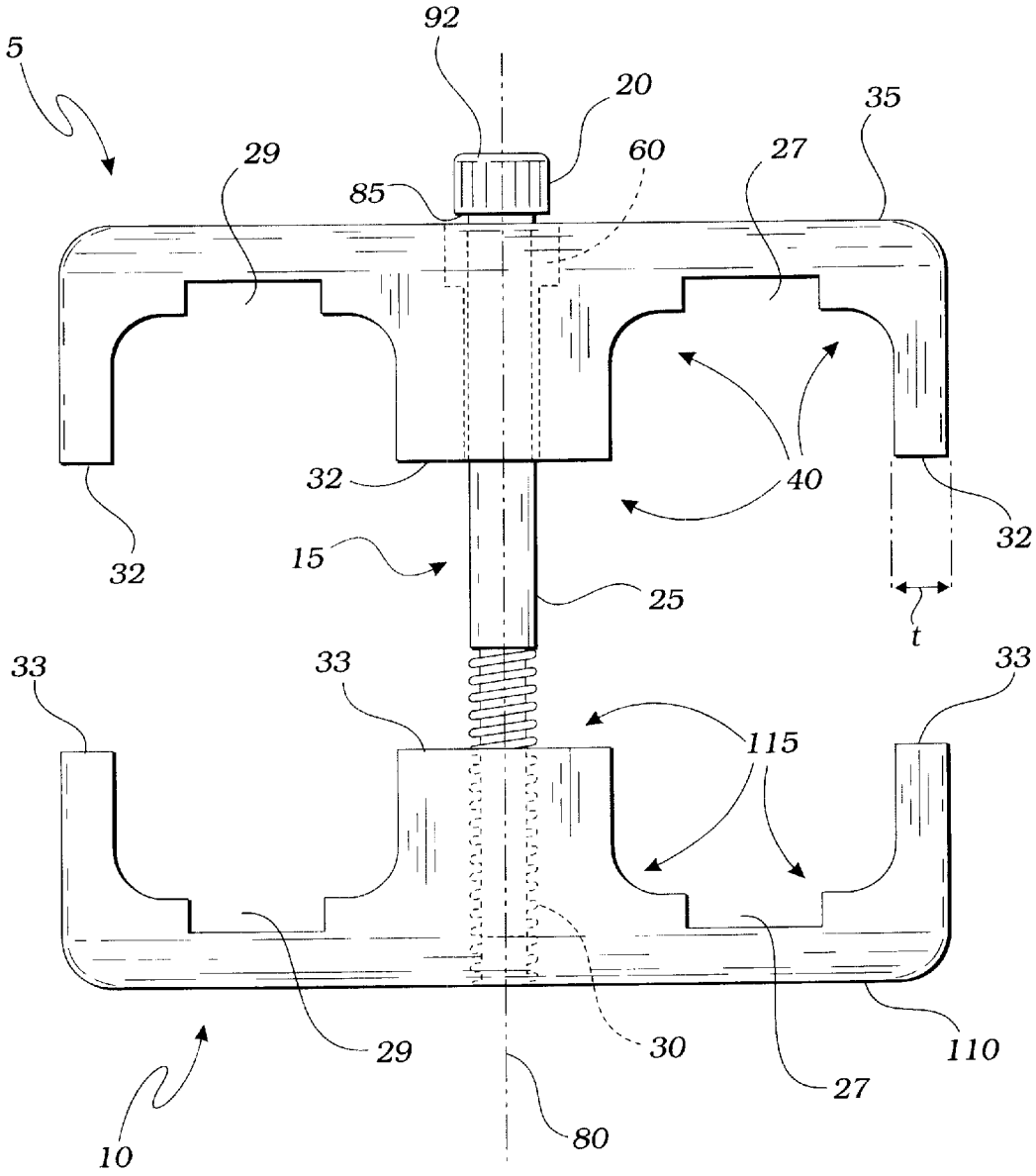
FIG. 2*a* is an elevational view of one embodiment of the firearm magazine holder in accordance with the present invention, showing a lower plate with an aperture extending entirely therethrough.
Figure 2B:
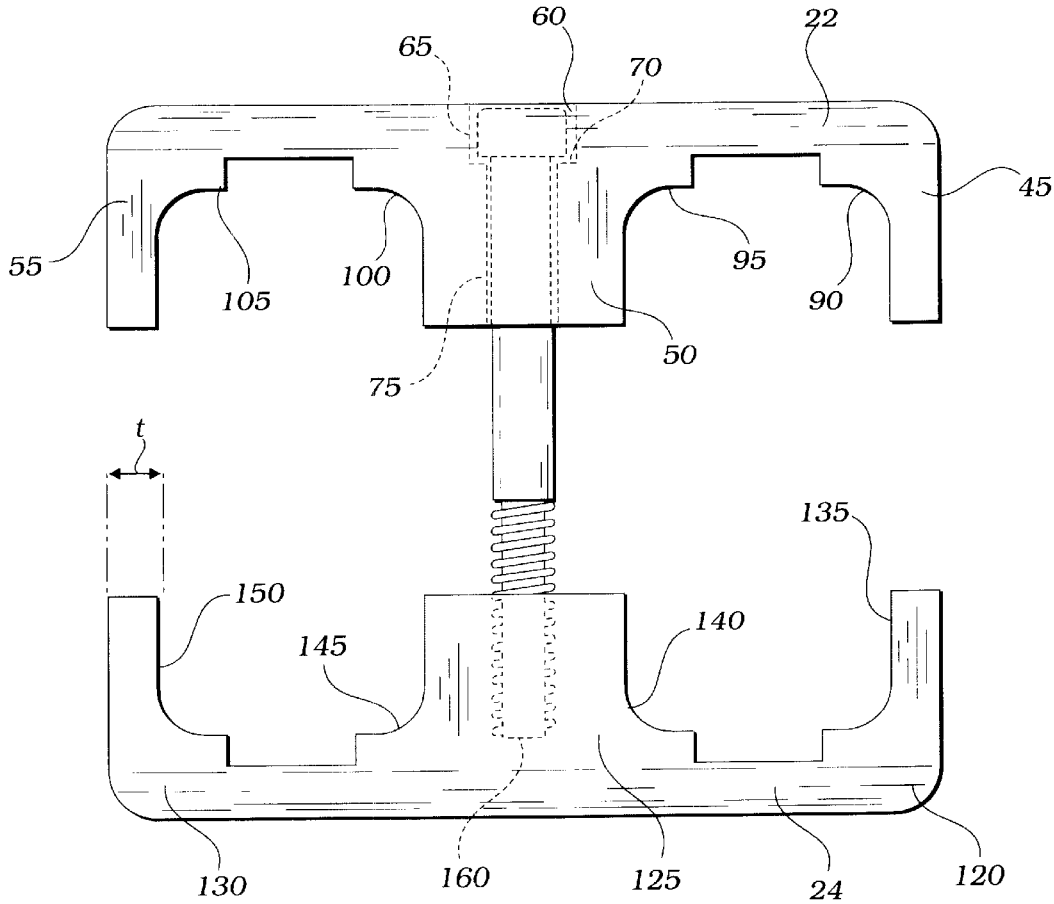
FIG. 2*b* is an elevational view of one embodiment of the firearm magazine holder in accordance with the present invention, showing a lower plate with an aperture extending only partially therethrough.

Referring now to FIGS. 2*a*–2*b*, elevational views of a preferred embodiment of the firearm magazine holder in accordance with the present invention are shown. FIG. 2*a* shows an embodiment of the present invention having a lower plate 10 with an aperture 160 that extends entirely therethrough, while FIG. 2*b* shows an embodiment having a lower plate 10 with an aperture 160 that extends only partially therethrough. Each of FIGS. 2*a*–2*b* show a device having an upper plate 5, a lower plate 10, and a securing member 15. The securing member (shown in more detail in FIG. 6) comprises a head 20, body 25, and foot 30. The head 20, body 25, and foot 30, are not necessarily distinct portions of the securing member 15, but rather these terms are used for reference to define approximate portions of the securing member 15 relative to each other. That is, the head 20 is at the top, the foot 30 is at the bottom, and the body 25 is therebetween. Together, the head 20, body 25, and foot 30 form a continuous securing member 15. There is no exact point at which the head 20 ends and the body 25 begins, or the body 25 ends and the foot 30 begins, although the head 20 and the foot 30 each preferably have physical characteristics to distinguish them from the body 25, as described herein.

Figure 3A:
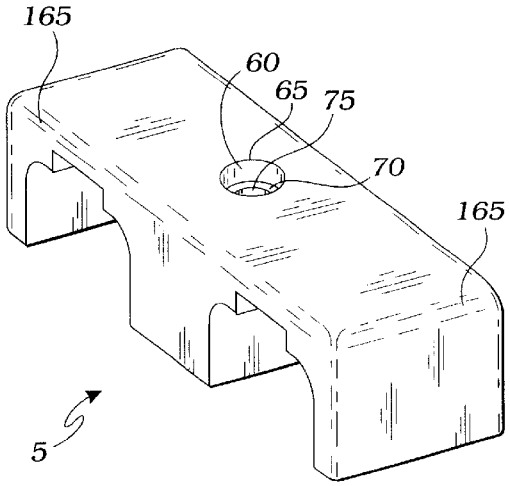
FIG. 3*a* is a perspective view of the top of an upper plate of a firearm magazine holder in accordance with the present invention, having substantially curved outer edge surfaces.
Figure 3B:
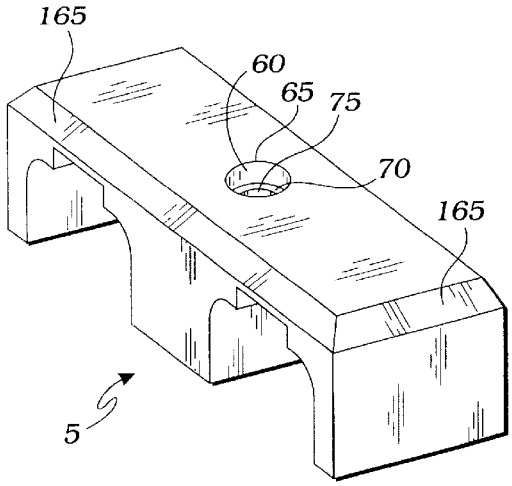
FIG. 3*b* is a perspective view of the top of an upper plate of a firearm magazine holder in accordance with the present invention, having chamfered outer surface edges.

The upper plate 5 includes an outer surface 35 and an inner surface 40. The upper plate further includes a right extension 45, center extension 50, and left extension 55. Additionally, the upper plate includes a recess/countersink 60, as best seen in FIGS. 3*a*–3*b*. The recess 60 has an outer circumference 65, an inner lip 70, and an aperture/counterbore 75. The recess 60 is of a sufficient size and shape to accommodate the securing member 15. The inner lip 70 of the recess 60 extends radially inward to define the aperture 75 in the upper plate. Both the upper plate 5 and the lower plate 10 may optionally have respective indents or contact wells 72 (see FIG. 4) on either or both of the front surfaces 22 and 24, and/or either or both of back surfaces (not shown). The contact wells 72 facilitate gripping the magazine holder by providing an indexing area for the user's thumb and/or index finger.

Figure 6:
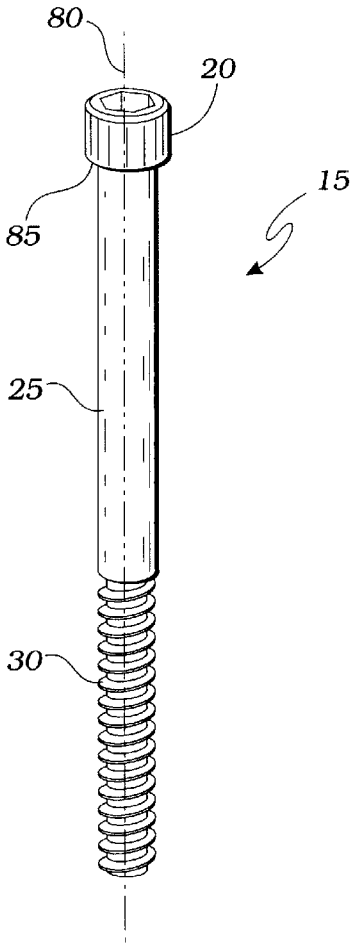
FIG. 6 is a perspective view of a preferred embodiment of the securing member of the present invention.

The typical securing member 15 is a threaded bolt or screw (see, e.g., FIG. 6) wherein the foot 30 of the securing member 15 is threaded, and the aperture 160 of the lower plate 10 is correspondingly threaded to receive the foot 30 of the securing member 15. Examples of a securing member include a pan head screw or lag bolt. The securing member head 20 may incorporate various tightening means including recesses for hex, slotted, or Phillips hardware. Additionally, the securing member head 20 may include a gripping means such as serrations, ribs, or a roughened surface to facilitate tightening of the securing member 15. The foot 30 of the securing member 15 may be threaded, expandable, or of the locking helicoil type. One such securing member 15, a threaded hex head bolt, is shown in FIG. 6. A central longitudinal axis 80 of the securing member 15 is defined for reference.

The outer circumference 65, inner lip 70, and aperture 75 generally form concentric circles, as shown in FIGS. 3*a*–3*b*. The aperture 75 is surrounded and defined by the inner lip 70, and extends entirely through the upper plate 5 from the outer surface 35 thereof to the inner surface 40 thereof. Generally, with placement of the securing member 15 into the upper plate aperture 75, the central longitudinal axis 80 thereof is positioned to pass vertically through the aperture 75. The inner lip 70 provides an area for engaging the securing member head 20. Typically, the depth of the recess 60 from the outer surface 35 of upper plate 5 to the inner lip 70, is sufficient to allow the bottom surface 85 of the securing member head 20 to rest on the inner lip 70, while the top surface 92 of securing member head 20 is substantially flush with the outer surface 35 of the upper plate 5, as shown in FIG. 2*b*. The head 20 may also be substantially contained within recess 70, such that the top surface 92 of the securing member head 20 is at or below the outer surface 35 of upper plate 5. The recess aperture 75 allows the securing member foot 30 and the securing member body 25 to pass unobstructed therethrough, but prohibits the securing member head 20 from passing therethrough.

Figure 7:
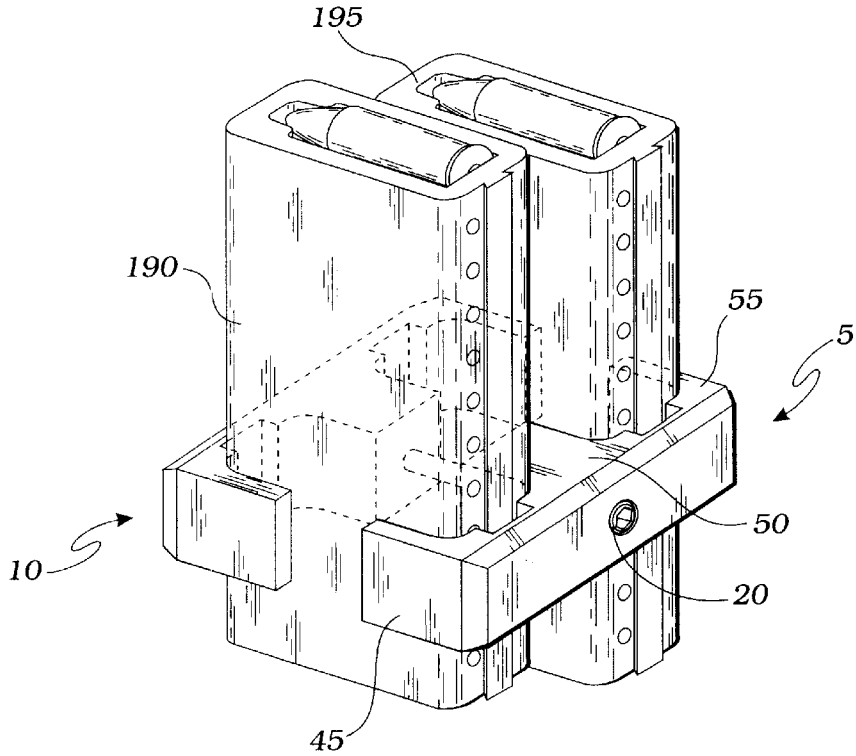
FIG. 7 is a perspective view of the firearm magazine holder of FIG. 4, holding two magazines.

As shown in FIGS. 2*a* and 2*b*, the inner surface 40 of the upper plate 5 includes inner surfaces 90 and 105 of the right extension 45 and left extension 55 respectively, and the first inner surface 95 and the second inner surface 100 of the center extension 50. Collectively, as shown in FIG. 7, the upper plate inner surfaces 90, 95, 100, 105 define first and second slots 27 and 29 respectively for receiving first and second firearm magazines respectively, and for engaging portions of the firearm magazine(s)' side or casing. Specifically, the first inner surface 95 of the center extension 50 and the inner surface 90 of the right extension 45 form a surface for engaging a first magazine within a first slot 27. Another surface for engaging a second magazine is formed by the second inner surface 100 of the center extension 50 together with the inner surface 105 of the left extension 55 within second slot 29.

Similar to the upper plate 5, as shown in FIGS. 2*a*–2*b*, the lower plate 10 includes an outer surface 110 and an inner surface 115. The lower plate further includes a right extension 120, center extension 125, and left extension 130 corresponding to the similar aspects of the upper plate 5. The inner surface 115 of the lower plate 10 forms inner surfaces 135 and 150 of the right extension 120 and left extension 130 respectively, and the first inner surface 140 and the second inner surface 145 of the center extension 125. Collectively, as shown in FIG. 7, the bottom plate inner surfaces 135, 140, 145, 150 define first and second slots 27 and 29 respectively for receiving first and second firearm magazines respectively, and for engaging portions of the firearm magazine(s)' side or casing. Specifically, the first inner surface 140 of the center extension 125 and the inner surface 135 of the right extension 120 form a surface for engaging a first magazine within first slot 27. Another surface for engaging a second magazine within second slot 29 is formed by the second inner surface 145 of the center extension 125 and the inner surface 150 of the left extension 130.

The combined inner surfaces 90, 95, 100, 105, 135, 140, 145, 150 of the upper plate 5 and the lower plate 10 thus define slots 27 and 29, and provide surfaces for engaging two firearm magazines. The configuration or shape of the aforementioned inner surfaces may be adapted to substantially conform to the sides or casing of various magazines to be held. For example, the drawings illustrate a device for use with an M16 automatic rifle, and particularly thirty round United States military 5.56 mm M16A2 Service Rifles or NATO issue M16s. Other firearms with magazines compatible with the present invention include but in no way are limited to: Bushmaster M17S, XM15E2S, AR-180B, CAV-15's, M96 Rifle, M16 Series, AR-15's, M14s, AK47, Fabrique National Series, AR10, M14, and the U.S. military's M249 Squad automatic Weapon (SAW). The device of the present invention is useful with metal, plastic, or nylon magazines. Inner surfaces of an upper plate and lower plate that substantially conform to the side or casing of the magazine(s) will facilitate greater surface area contact for securing the magazine(s) than inner surfaces that are not as precisely shaped. The combined inner surfaces of the upper plate 5 and lower plate 10 may be serrated, ribbed, or roughened in order to provide an additional means for gripping the magazine(s).

The terms first magazine 190 and second magazine 195 are used for descriptive purposes only and are in no way meant to limit the order or location of magazine placement in accordance with the present invention. A thickness of not greater than approximately 0.12 inches of the distal portion of the right extensions 45, 120 and the left extensions 55, 130, as shown by distance "t" in FIGS. 2*a*–2*b*, provide excellent combined performance features of weight, strength, and durability. The upper plate 5 and lower plate 10 may be constructed from a wide variety of materials. For example, the upper plate 5 and lower plate 10 may be constructed of titanium alloy, fiberglass, plastic, or aluminum. A preferred material is tempered T6 aluminum square/rectangular bar, one weight percent black anodized. The black color helps make the device non-reflective.

Lower plate 10 includes an aperture 160 for receiving the securing member foot 30. Typically, the aperture 160 is threaded to receive a threaded foot 30. The aperture 160 may extend partially through lower plate 10, as shown in FIG. 2*b*, or entirely through, as shown in FIG. 2*a*, and may contain a helicoil (not shown) therein.

In one embodiment, as in FIGS. 2*a*–2*b*, the upper plate 5 and the lower plate 10 are substantially the same size and shape, and are positioned symmetrically to one another relative the securing member body 25. Upper and lower plates 5 and 10 are preferably mirror images of each other, excluding the recess 60 of upper plate 5 and the aperture 160 of the lower plate. The plates 5, 10 are thus substantially symmetric to each other relative the central longitudinal axis 80 of securing member 15 when in use. This is best seen in FIGS. 2*a*–2*b*, and FIG. 7. Using substantially the same size and shape for the upper plate 5 and lower plate 10 facilitates application of a uniform pressure on the side or casing of the firearm magazine(s) when tightening the securing member 15. Additionally, the application of a uniform pressure while tightening the securing member 15 enhances the ability of the present invention to securely hold multiple magazines when compared to the prior art shown in FIG. 1.

For example, in order to apply even pressure on a plurality of magazines, the prior art device would require an individual to alternate back and forth between tightening two different bolts "B". Back and forth tightening of the bolts is not only time consuming but quite imprecise as a method of achieving uniform pressure to the firearm magazines. Typically, the surface of the middle magazine will have a greater pressure applied than the surfaces of the outer magazines. Additionally, as the plurality of magazines are emptied of their ammunition, the hollow magazine casings will tend to deform slightly from the applied pressure. The deformed magazine side or casing will further reduce the pressure on the surface of the outer magazines resulting in unsecured magazines. On the other hand, precise and evenly applied pressure, through the use of a single centrally located securing member 15 as described herein, will remain substantially consistent even when the magazines are empty.

Figure 3C:
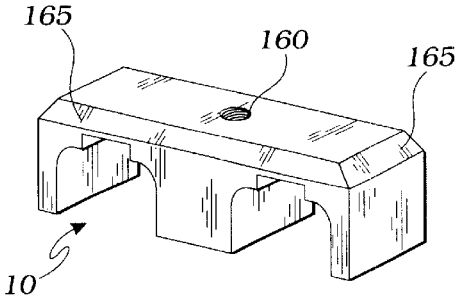
FIG. 3*c* is a perspective view of the bottom of a bottom plate of a firearm magazine holder in accordance with the present invention.

Turning now to FIGS. 3*a*–3*b*, perspective views of the top of an upper plate 5 are shown. FIG. 3*a* shows one embodiment of upper plate 5 with curved outer edge surfaces 165 at the transition from outer surface 35 to front surface 22 and back surface (not shown), and FIG. 3*b* shows another embodiment of upper plate 5 with chamfered outer edge surfaces 165. FIG. 3*c* shows a perspective view of the bottom of a bottom plate 10. The plates 5 and 10 have chamfered or substantially curved outer edge surfaces 165. Typically, the degree of curvature of the substantially curved outer edge surfaces 165 is greater than the degree of curvature at edges between front surfaces 22 and 24 and inner surfaces 40 and 115 respectively, which may be only subtly curved to eliminate sharpness. The curved surfaces are also known as "bull-nosed" or "radialed" surfaces, to distinguish them from sharp edges common in the prior art devices. A preferred degree of curvature of the outer edge surfaces 165 of plates 5 and 10 is 0.18 inches.

Figure 1:
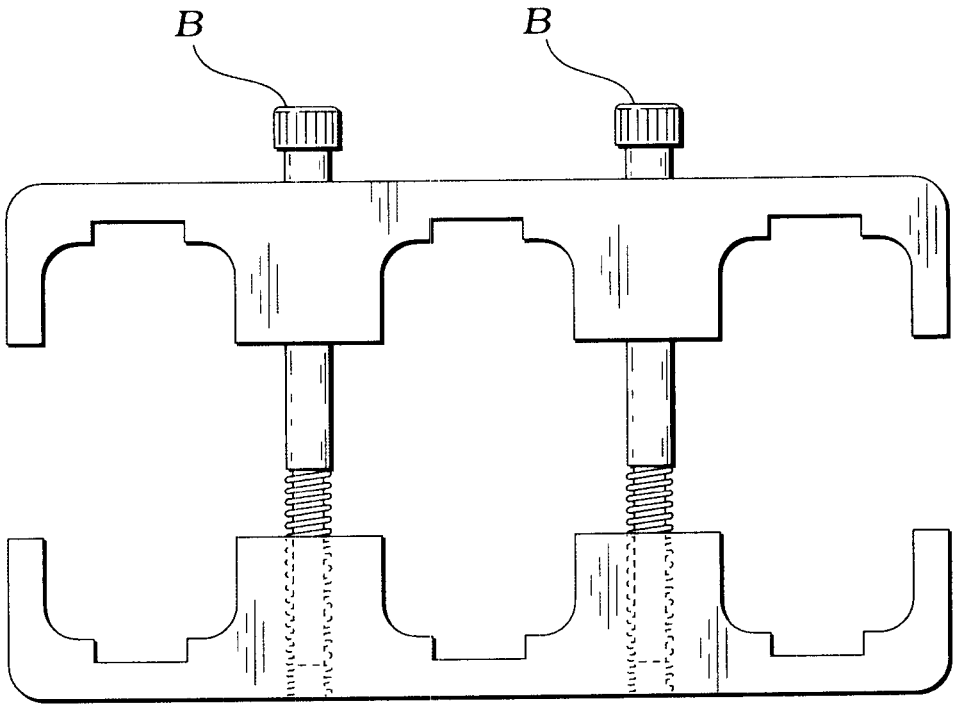
Prior Art Fig. 1
FIG. 1 shows a prior art magazine holder.

The substantially curved edge surfaces, including outer edge surfaces 165, along with upper plate recess 60, eliminates sharp edges and permits the top surface 92 of the securing member head 20 to be substantially flush with the outer surface 35 of the upper plate S while in use, thus reducing the potential for injury due to sharp and/or protruding surfaces, edges and/or objects when compared to prior art devices. As shown in FIG. 1, for example, the prior art device utilizes bolts that protrude above the outer surface of the upper plate. The protruding bolts increase the potential that an individual may be cut, bruised, scraped, or otherwise injured. In addition, clothing may become snagged or caught on the protruding bolts causing an unwanted mishap or accident. In contrast, the recessed top surface 92 of the securing member head 20, and substantially curved and/or chamfered outer surface edges 65 of the plates 5, 10 of the present invention, offer a profile void of any obtrusive structures.

Another potential problem area of the prior art is the sharp merging edge surfaces. The merging surfaces of the prior art form well-defined edges that may cause damage to a person's skin. Sharp edge surfaces are utilized throughout the prior art devices. In contrast, the substantially curved edge surfaces of the device of the present invention offer a smooth transition from one surface to another. The substantially curved edge surfaces of the present invention, including outer edge surfaces 165, thus reduce the potential for cuts, punctures or other damage to the skin. Similarly, the heads of the bolts "B" in the prior art devices, as seen in FIG. 1, protrude due to the lack of a recess in the upper plate of the prior art device for receiving them, and such protruding metal may also be a potential source of cuts, bruises, etc.

Figure 4:
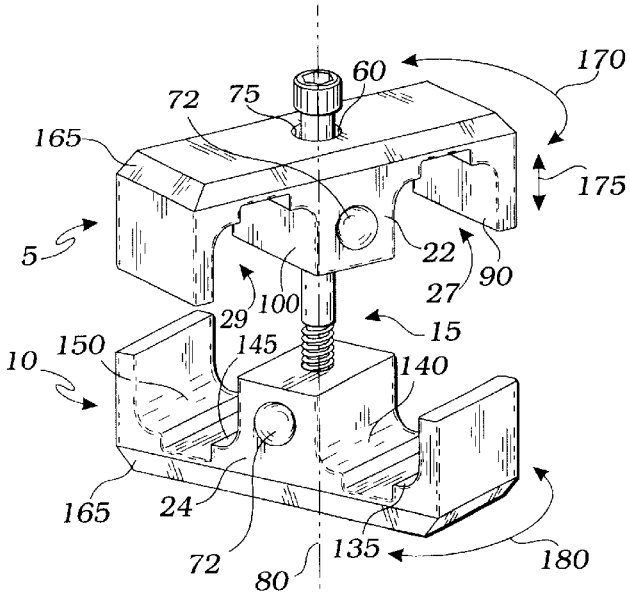
FIG. 4 is a perspective view of a preferred embodiment of a firearm magazine holder in accordance with the present invention.

Turning now to FIG. 4, a perspective view of a preferred embodiment of the firearm magazine holder in accordance with the present invention is shown. The upper plate 5 and the lower plate 10 are capable of multidirectional movements 170, 175, 180. Multidirectional movements 170, 175, 180 of the upper plate 5 and lower plate 10 are made possible due to the physical relationship and placement of the plates 5, 10 with respect to each other and with respect to the securing member 15. The upper plate 5 is rotationally positioned about the securing member 15 as best seen in FIG. 4. The upper plate aperture 75 encircles the securing member 15, but it is not physically connected thereto, thus allowing free/unrestricted 360 degree rotation about the central longitudinal axis 80 of the securing member in both directions, as seen by directional arrow 170.

Upper plate 5 is also free to move vertically relative the central longitudinal axis 80 of the securing member 15, as indicated by directional arrow 175. Such linear movement is referred to herein as translation, to distinguish from rotational movement as indicated by arrow 170. The upward limit of vertical translation of the upper plate 5 is defined by the dimensions of the head 20 of the securing member 15 in relation to the depth of recess 60 and inner lip 70. That is, as upper plate 5 is translated upward, head 20 is received into recess 60 and the bottom surface of head 20 engages inner lip 70 preventing further vertical translation of upper plate 5. A split washer (not shown) may also be placed on inner lip 70 such that the head 20 engages the washer instead. It is intended that in such a configuration the bottom surface of head 20 is still considered to be engaging the inner lip 70, even though there may not be direct physical contact between the two. This same relationship may be viewed from the perspective of the securing member 15, as preventing securing member 15 from passing entirely through countersink 60.

The downward limit of vertical translation of the upper plate 5 is defined by the relationship of the upper plate 5 to the lower plate 10. Specifically, the lower plate 10 is secured by being mounted to the foot 30 of the securing member 15. As such, when inner surfaces 32 of upper plate 5 engage inner surfaces 33 of lower plate 10, upper plate 5 is prevented from further downward translational movement. Also, when the device is in use, the body of the magazines 190, 195 will prevent such translational movement once the magazines 190, 195 are secured, as seen in FIG. 7.

In one embodiment, in which aperture 160 extends entirely through lower plate 10 (see FIG. 2*a*), the boundaries of rotational movement of the lower plate 10, as shown by directional arrow 180, are defined by the thread length of the securing member foot 30. In another embodiment, in which aperture 160 does not extend all the way through lower plate 10 (see FIG. 2*b*), such rotational movement may additionally or alternatively be limited by the depth of aperture 160. In either case, rotational movement of lower plate 10 is typically free within a range of at least 5 degrees in either direction.

It will be apparent to those skilled in the art that the rotational movement described with respect to the lower plate 10 refers not only to rotation about the central longitudinal axis 80 of securing member 15, but also to vertical translation thereof due to the threaded properties of securing member foot 15 and aperture 160. In this respect, such rotational movement of the lower plate 10 varies from rotational movement of upper plate 5, because since upper plate 5 is not mounted it is capable of rotation without vertical translation. The rotation and vertical translation of the plates 5, 10 is thus restricted only as described herein, and the multidirectional movements 170, 175, 180 of the upper plate 5 and the lower plate 10 facilitate placement and securing of the magazines between the upper plate 5 and lower plate 10.

Turning now to FIG. 7, a perspective view of the firearm magazine holder of the present invention is shown holding two magazines 190, 195. The magazines 190, 195 are placed between the upper plate 5 and lower plate 10 in slots 27, 29, engaging the inner surfaces 40 and 115. Securing member 15 (not shown) is tightened to secure the magazines 190, 195 in place. When compared to the prior art device shown in FIG. 1, the multidirectional movements 170, 175, 180 of the upper plate 5 and the lower plate 10 greatly enhance placement and securing of the magazine(s) between the upper plate 5 and lower plate 10. The prior art device requires the magazines to be inserted along well-defined channels in order to be placed properly within the upper and lower plates. At best, the prior art provides only minute movement of the upper plate and essentially no movement of the lower plate, making placement of a magazine cumbersome. Any rotational movement of the plates in the prior art device is insignificant and not measurable, and is at most on the order of less than 1 or 2 degrees. Also, an individual must alternate back and forth between adjusting the two protruding bolts of the prior art device in order to tighten the device. The technique of adjusting two bolts is time consuming. Additionally, unless the two bolts are adjusted equally, the upper and lower plates will not form an even, proper, channel for placement of the magazines.

In contrast, multidirectional movement of the plates 5, 10 of the present invention as described herein provides the upper plate 5 and lower plate 10 with a greater degree of rotational and translational movement for quick and easy placement of the magazines. Properly placing and securing of the magazines will result in the securing member head 20 being substantially within recess 60 and/or substantially flush with the outer surface 35 of the upper plate 5. In either case, the head 20 will not protrude beyond the outer surface 35 of upper plate 5. A separate embodiment includes a mushroom or domed head of the securing member 15, such that even if it protrudes slightly, it does not contain any sharp edges. Magazines may be placed between the upper plate 5 and lower plate 10 in a parallel configuration. Alternatively or additionally, the magazines may be placed in a vertically staggered configuration as seen in FIG. 7, or inverted in relation to each other. In one embodiment (not shown) the device may be configured to receive two magazines such that they are positioned at 45 degree angles to each other relative the plane of front surfaces 22, 24, or to receive a plurality of magazines in other formations such as a circular or partially circular formation. A single magazine or a plurality of magazines may be used in accordance with the present invention.

Figure 5:
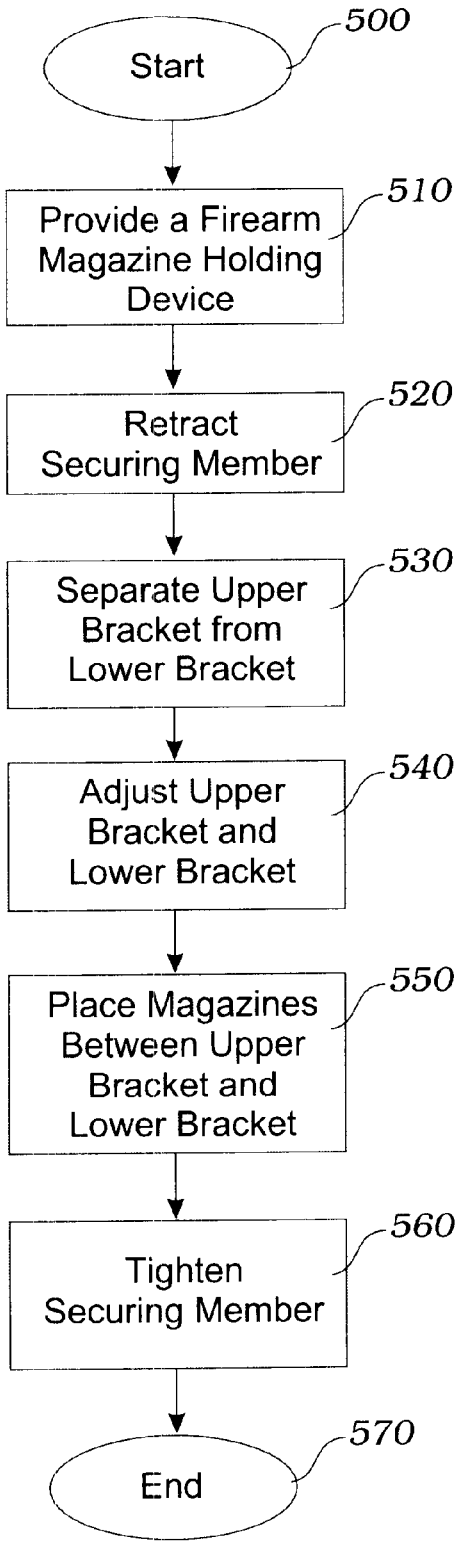
FIG. 5 is a flow chart illustrating a method of securing a plurality of firearm magazines in a device in accordance with the present invention.

Turning now to FIG. 5, a flow chart illustrating a method of holding a plurality of firearm magazines in accordance with the present invention is shown. The process begins at 500. At step 510, a firearm magazine holding device as described herein is provided. A manufacturer, distributor, or other third party may supply the device. In this respect, "providing" the device is intended to refer to the fact that such a device is in fact present in use with the method, and so the device may be provided by the actual user thereof.

The securing member is then retracted from the lower plate, as seen in step 520. Typically, retraction of the securing member is accomplished by unscrewing the threaded foot of the securing member from the threaded aperture of the lower plate. This step is optional, as it is intended to refer to the rotational movement of the lower plate clockwise such that as the lower plate translates lower, in effect the securing member translates upward or is retracted from the lower plate. This is optional because it is very likely that the lower plate will be rotated only counterclockwise, or not at all, since tightening the device does not require retraction of the securing member. In other words, the lower plate may remain stationary, while the securing member is tightened thus causing the securing member to be inserted into the lower plate and not retracted therefrom.

At step 530, the upper plate and lower plate are separated in order to provide sufficient space between the upper plate and lower plate for placement of the magazine(s). At step 540, the upper plate and lower plate are adjusted to accommodate placement of the magazine(s) between the upper plate and the lower plate. Adjustment of the upper plate may include rotational and translational movement as described herein. Adjustment of the lower plate may include rotational movement as described herein. At step 550, the magazine(s) are placed between the upper plate and the lower plate. At step 560, the securing member is tightened. Tightening of the securing member brings the applicable inner surfaces of the upper plate and the lower plate into contact with the side or casing of the magazine(s), and places the top surface of the securing member head in a position substantially within the recess and/or flush with the upper surface of the upper plate.

Typically, the shape of the inner surfaces of the upper plate and the lower plate will substantially conform to the side or casing of the magazine(s) to be held. Inner surfaces of an upper plate and lower plate that substantially conform to the side or casing of the magazine(s) will facilitate greater surface area contact for securing the magazine(s). The process ends at step 570, at which time the first magazine may be inserted into the firearm well. Once the first magazine is emptied, the device (with the magazines secured therein) may be disengaged from the firearm, and the unspent magazine may then be inserted into the firearm well.

The multidirectional movement of the upper plate 5 and lower plate 10, substantially curved edge surfaces (including outer edge surfaces 165) and/or chamfered outer edge surfaces 165, recessed securing member head 20, and other structural elements as described herein, thus provide for a device capable of holding a plurality of firearm magazines that is more efficient, safer, highly effective, and more reliable than known devices.

Figure 8:
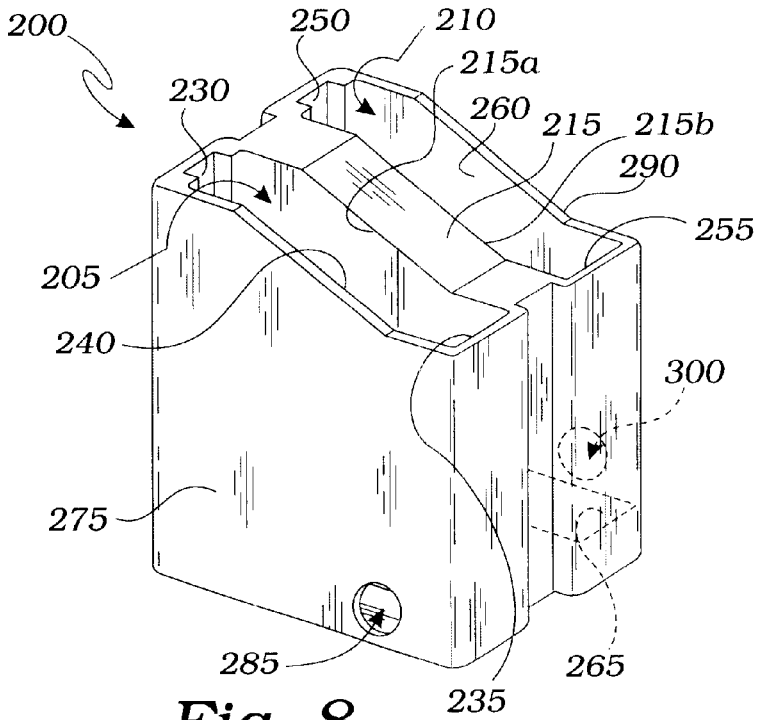
FIG. 8 is a perspective view of another embodiment of a firearm magazine holder in accordance with the present invention.

Turning now to FIG. 8, another embodiment of the present invention is shown. This embodiment is a magazine holder with a body 200 having a first compartment 205 adapted to receive a first magazine 205*m*, and a second compartment 210 adapted to receive a second magazine 210*m*. The first compartment 205 and the second compartment 210 are separated by a divider 215, having a first side wall 215*a* and a second side wall 215*b*.

The body 200 is a single-piece body as best seen in FIGS. 8–13. That is, the body 200 may be machined from a single block of material, molded from a single mold cavity, cast from a single mold, or otherwise formed as a single-piece integrated body. The body 200 may be constructed of any type of metal, plastic, or like material that permits the body 200 to be formed as a single-piece. The single-piece construction decreases the complexity of manufacture and maintenance. In one embodiment, the body 200 comprises UHMW (ultra-high molecular weight) polyethylene, such as the OK 2000 supplied by TSE-OKULEN Americas, L.L.C., of Clearwater, Fla. Typically, the UHMW polyethylene material is abrasion and impact resistant, to lessen the likelihood of marring or scratching the finish of the magazines 205*m*, 210*m*. Also typically, the material is non-reflective. In a preferred embodiment, the front wall 235 of the first compartment 205 extends to the inner bottom surface 245 of the first compartment 205, and the front wall 255 of the second compartment 210 extends to the inner bottom surface 265 of the second compartment 210. Also, the front wall 235 of the first compartment 205 and the front wall 255 of the second compartment 210 are substantially coplanar.

Figure 9:
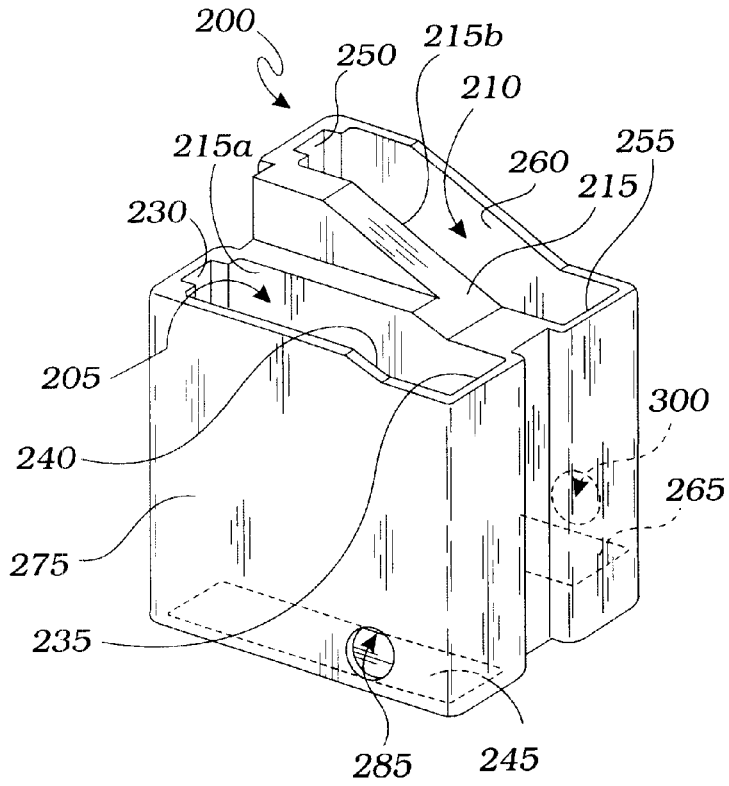
FIG. 9 is a perspective view of another embodiment of a firearm magazine holder in accordance with the present invention.

The divider 215 is preferably solid between its two side walls 215*a* and 215*b*, and may be substantially flat (not shown), fully ramped (as seen in FIG. 8), or partially ramped (as seen in FIG. 9). In a fully ramped embodiment, the front wall 255 of the second compartment 210 extends upward to a different vertical height than does the back wall 250 of the second compartment 210, and the front wall 235 of the first compartment 205 extends upward to a different vertical height than does the back wall 230 of the first compartment 205. In a partially ramped embodiment, part of the divider 215 may be substantially flat, whereas part of the divider 215 may be ramped. For example, the first side wall 215*a* of the divider 215 may have a substantially uniform height, whereas the second side wall 215*b* of the divider 215 may have a ramped non-uniform height.

Figure 14B:
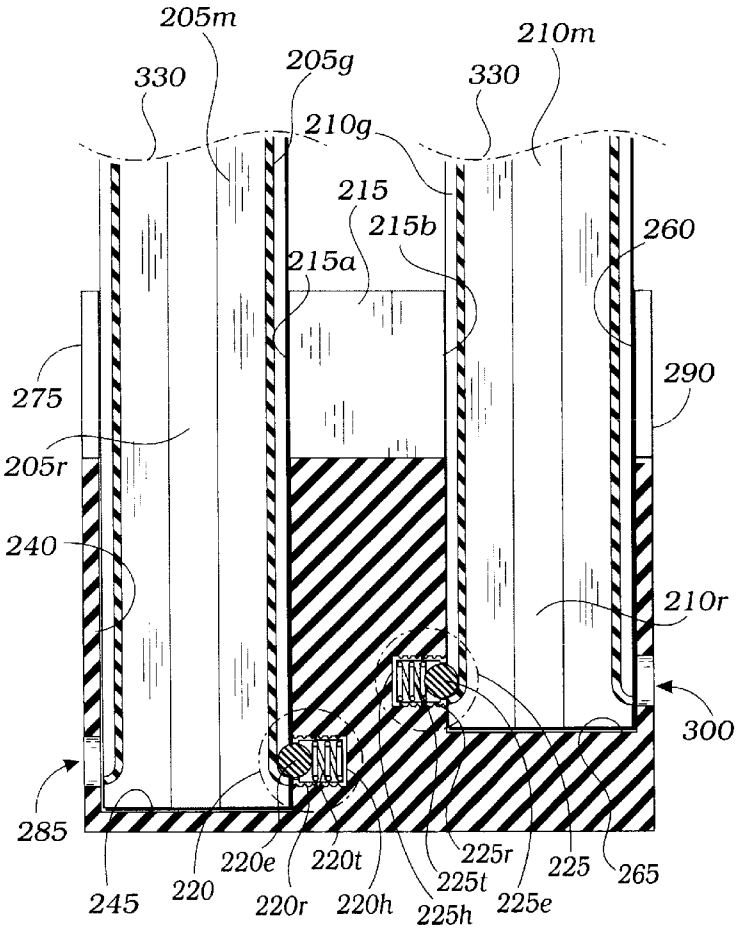
FIG. 14B is a sectional view of the firearm magazine holder of FIG. 11 (presuming the magazine holder is that of FIG. 9) with both magazines in the magazine wells, taken along line 14—14 of FIG. 11, viewed from below line 330, showing the securing members engaging corresponding magazines.

Ramping or partial ramping up of the divider 215 provides extra lateral stability to magazines 205*m* and/or 210*m*, and may be desirable depending on the specific weapon system being used. In a substantially flat, or fully ramped embodiment, the inner bottom surface 245 of the first compartment 205 and the inner bottom surface 265 of the second compartment 210 are substantially coplanar. In a partially ramped embodiment, the inner bottom surface 245 of the first compartment 205 and the inner bottom surface 265 of the second compartment 210 may lie in different, but substantially parallel planes, such that they are staggered or offset, which in turn provides for staggering/offsetting of the magazines 205*m*, 210*m*. The maintenance holes 285, 300 and the securing member housings 220*h*, 225*h* would typically be correspondingly offset, so the securing members 220, 225 (all described more fully herein) could be easily accessed for maintenance, and properly positioned to engage the magazines 205*m*, 210*m*. This is best seen in FIG. 14B. For certain weapon systems, the staggering facilitates a proper transition from one magazine (e.g., the first magazine 205*m*) to another magazine (e.g., the second magazine 210*m*) into the weapon's magazine well during use of the weapon.

Figure 10:
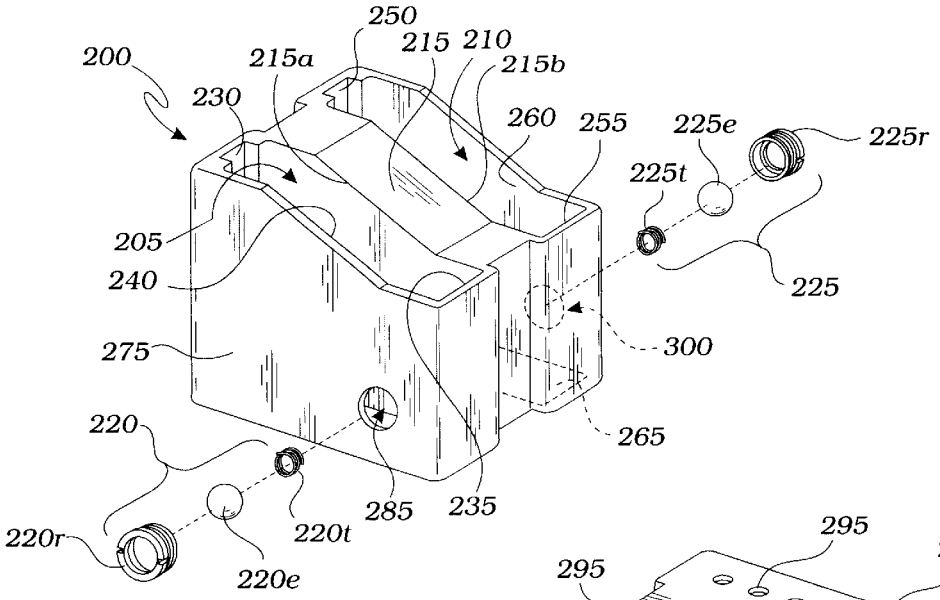
FIG. 10 is a perspective view of another embodiment of a firearm magazine holder of the present invention, showing an exploded view of a first securing member and a second securing member.

The width of the divider 215 may vary to accommodate various weapon systems. For example, the width of the divider 215 shown in FIG. 10 is greater than the width of the divider shown in FIG. 8. Typically, a magazine holder having a divider with a width of approximately 0.78 inches is used with a weapon such as an M16, AR15, M4, and/or similar weapon system. A magazine holder having a divider with a width of approximately 0.468 inches is used with an F2000 integrated weapon system, used by NATO forces.

Figure 13:
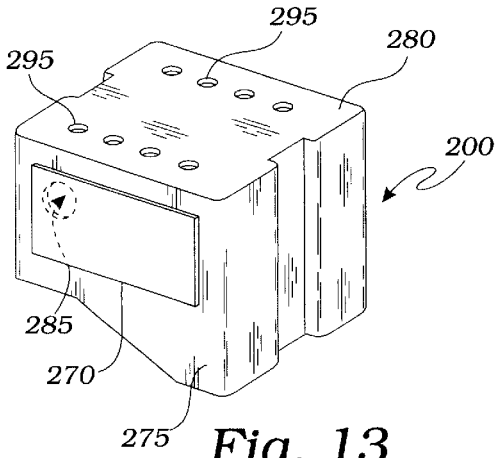
FIG. 13 is a bottom perspective view of the firearm magazine holder of FIG. 8, further showing irrigation holes and grip tape.
Figure 12:
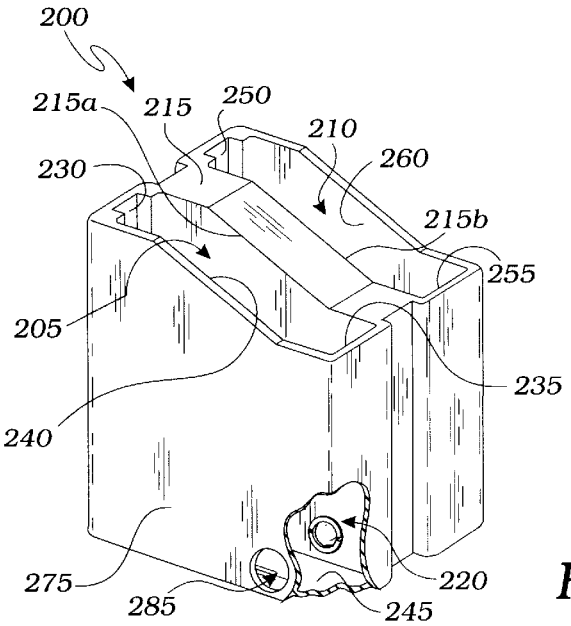
FIG. 12 is a partial cut-away view of the firearm magazine holder of FIG. 8, showing a securing member installed.

The body 200 may optionally have an anti-slip surface 270, as seen in FIG. 13. An anti-slip surface 270 enhances the user's grip and control of the body 200 during use. The anti-slip surface 270 may be etched into the body 200, or otherwise formed in the body 200 during molding, machining, or other manufacturing technique, such that the surface 270 is an integral part of the body 200. For example, the surface 270 may simply be textured or ribbed. The surface 270 may alternatively be applied to the body 200 as a separate feature. For example, grip tape, rubber pads, or other anti-slip material may be applied to suitable locations on the body 200, such as on first exterior side wall 275 and/or second exterior side wall 290. In the latter case, the body 200 may be formed with suitable bevels or recessed areas to receive the grip tape or other anti-slip material.

The body 200 also optionally has a first maintenance hole 285 to allow access to the first securing member 220 through the first compartment 205, and which is sized to allow the first securing member 220 to pass therethrough. The first maintenance hole 285 is typically in the first exterior side wall 275 of the body 200. Access to the first securing member 220 may be necessary for maintenance, repair, or replacement thereof. Likewise, the body 200 optionally has a second maintenance hole 300 to allow access to the second securing member 225 through the second compartment 210, and which is sized to allow the second securing member 225 to pass therethrough. The second maintenance hole 300 is typically in the second exterior side wall 290 of the body 200.

Figure 14A:
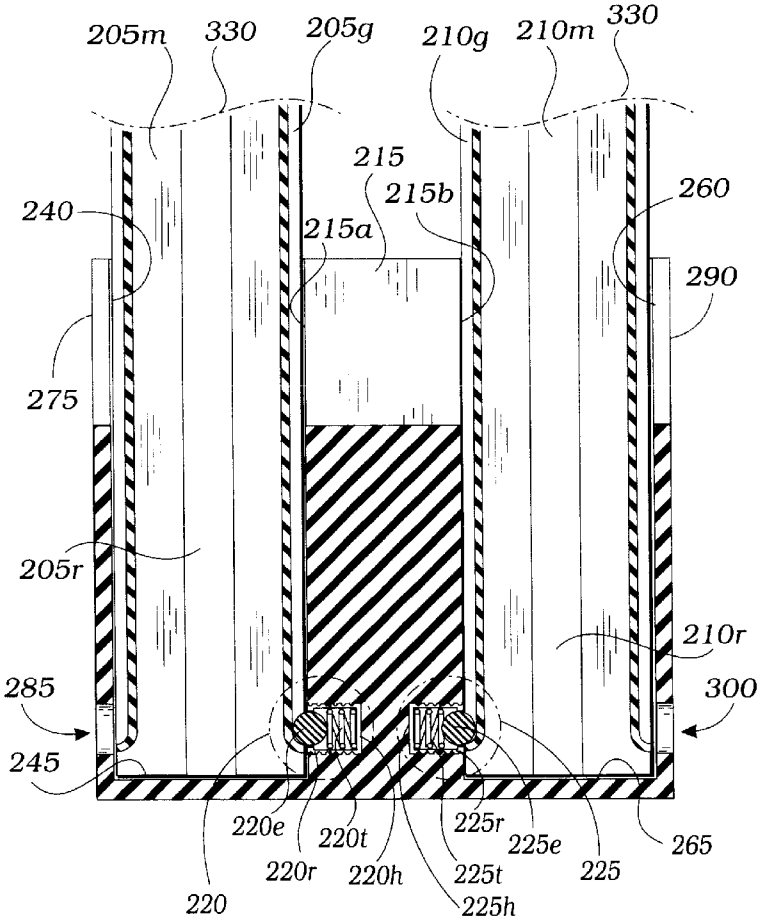
FIG. 14A is a sectional view of the firearm magazine holder of FIG. 11 (presuming the magazine holder is that of FIG. 8) with both magazines in the magazine wells, taken along line 14—14 of FIG. 11, viewed from below line 330, showing the securing members engaging corresponding magazines.
Figure 15:
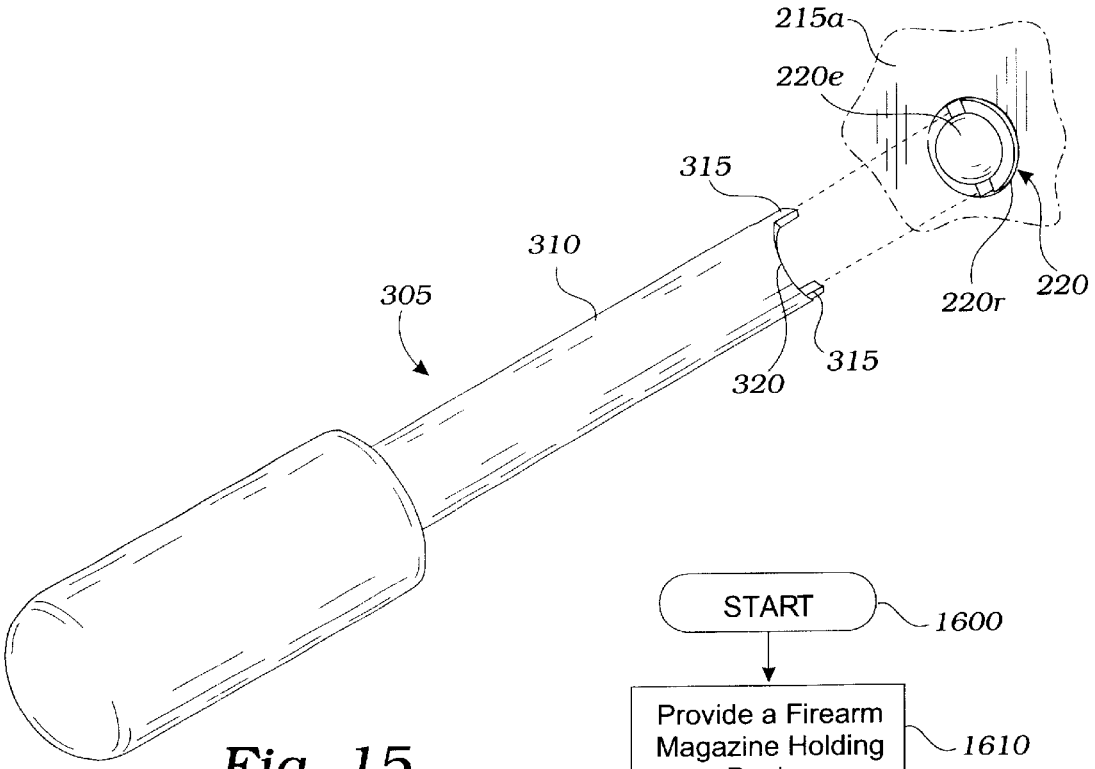
FIG. 15 is a perspective view of a tool for use with the magazine holder of FIGS. 8–10.

A suitable tool 305 such as that seen in FIG. 15 may be used for maintenance, repair, or replacement of securing members 220, 225. FIG. 15 shows an unobstructed partial view of the first side wall 215*a* of the divider 215, with the first securing member 220 housed therein. Component parts of the first securing member 220 in the preferred embodiment shown in FIG. 15 are a first retaining member 220*r*, a first engaging member 220*e*, and a first tensioning member 220*t* (see FIGS. 10, 14A, and 14B), all described herein in more detail. The tool 305 in FIG. 15 has a body 310 having a diameter less than the diameter of the first maintenance hole 285, and having teeth 315 to grip securing member 220. The teeth 315 extend out a sufficient distance from distal tip 320 of tool 305, such that the teeth 315 may grip the first retaining member 220*r* (shown in FIG. 15 as a cap-screw) without interference from the first engaging member 220*e* (shown in FIG. 15 as a ball bearing). For the same reason, the distal tip 320 of the tool 305 may be contoured to correspond to the first engaging member 220*e*. As seen in FIG. 15, for example, the distal tip 320 of the tool 305 is concave to correspond to the convex surface of the first engaging member 220*e*, which is a ball bearing. The tool 305 may take on various embodiments as needed to access and maintain securing members 220, 225, depending on the mechanical structure of the securing members 220, 225.

The body 200 also optionally has an irrigation hole 295 in a bottom surface 280 thereof. The irrigation hole 295 allows water, sand, or other debris that may accumulate in the compartments 205, 210 during adverse operating conditions to escape therefrom. The body 200 may be designed with multiple irrigation holes 295, as seen in FIG. 13. The maintenance holes 285, 300 may also serve as irrigation means if left substantially unobstructed. For example, FIG. 13 illustrates grip tape 270 placed on the first exterior side wall 275 of the body 200 over the first maintenance hole 285. Such a configuration would not be desirable if the first maintenance hole 285 is intended to double as an irrigation means. If the maintenance holes 285, 300 are to double as irrigation means, they should be positioned near the bottom surfaces 245, 265 of compartments 205, 210, as the case may be.

Turning now to a more detailed description of the compartments 205, 210. The first compartment 205 is defined by a back wall 230, a front wall 235, a side wall 240, the first side wall 215*a* of the divider 215, and an inner bottom surface 245, which together form a substantially continuous surface. Likewise, the second compartment 210 is defined by a back wall 250, a front wall 255, a side wall 260, the second side wall 215*b* of the divider 215, and an inner bottom surface 265, which together form a substantially continuous surface. The inner bottom surfaces 245, 265 each act as respective seats on which the respective magazines 205*m*, 210*m* may rest when inserted in their respective compartments 205, 210.

Figure 11:
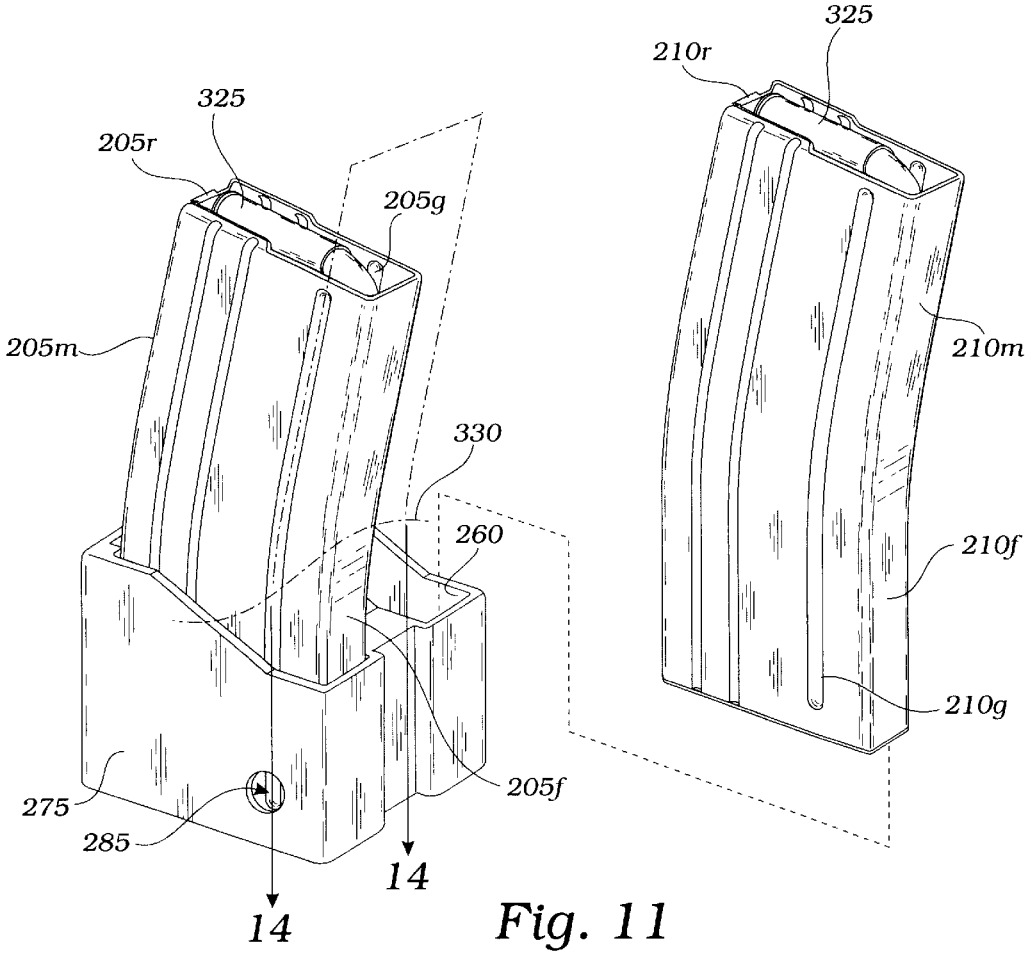
FIG. 11 is a perspective view of the firearm magazine holder of FIG. 8 or FIG. 9, further showing placement of magazines in the compartments.

Preferably, each compartment 205, 210 has a substantially similar horizontal cross-section, because they will be adapted to receive magazines 205*m*, 210*m* for the same weapon system. Also preferably, each compartment 205, 210 has a horizontal cross-section substantially similar to the horizontal cross-section of the magazines 205*m*, 210*m* respectively, to further facilitate secure seating of the magazines 205*m*, 210*m* therein, and to limit lateral movement of the magazines 205*m*, 210*m* within the compartments 205, 210. For example, the contours of the back walls 230, 250 and front walls 235, 255 correspond substantially to the contours of the magazines 205*m*, 210*m* respectively, in which back walls 230, 250 are contoured to receive ridges 205*r*, 210*r* of magazines 205*m*, 210*m* respectively, and front walls 235, 255 are contoured to receive substantially flat front portions 205*f*, 210*f* of magazines 205*m*, 210*m* respectively. A person of ordinary skill in the art would understand that rounds 325 are loaded in magazines 205*m*, 210*m* as shown in FIG. 11.

The dimensions of the compartments 205, 210 may be such that the magazines 205*m*, 210*m* fit snugly therein, even without the use of securing members 220, 225, such that even if the body 200 is turned upside-down with the magazines 205*m*, 210*m* in compartments 205, 210 respectively, the magazines 205*m*, 210*m* would not fall out. For example, the distance between the outer surface of the magazine 205*m* (other than at the grooves) and the respective walls 230, 215*a*, 235, 240 of first compartment 205 corresponding thereto, is preferably less than approximately two millimeters, and more preferably less than approximately one millimeter. These distances may be uniform, or not. In fact, non-uniformity may provide for a snugger fit. Further, the depth of each compartment 205, 210 is typically determined by the height of the magazines 205*m*, 210*m*, and the weapon system used with the magazine holder. For example, a compartment 205, 210 adapted to hold a thirty round magazine will typically have a depth greater than that of a compartment 205, 210 adapted to hold a twenty round magazine.

Turning now to FIG. 10, a perspective view of a firearm magazine holder in accordance with the present invention is shown, with an exploded view of securing members 220, 225. The securing member 220 will be described in detail, and it should be noted that the description of the securing member 220 applies correspondingly to the securing member 225. A preferred embodiment includes a first retaining member 220*r*, a first engaging member 220*e*, and a first tensioning member 220*t*, all as best seen in FIGS. 10, 14A, and 14B. The first securing member 220 is located within a first housing 220*h* of the divider 215, and is adapted to engage the first magazine 205*m* when the first magazine 205*m* is seated in the first compartment 205. Similarly, the second securing member 225 is located within a second housing 225*h* of the divider 215, and is adapted to engage the second magazine 210*m* when the second magazine 210*m* is seated in the second compartment 210.

Engagement of the first and second magazines 205*m*, 210*m* may be accomplished by the first securing member 220 being adapted to engage the first magazine 205*m* within a first groove 205*g* of the first magazine 205*m*, and the second securing member 225 being adapted to engage the second magazine 210*m* within a second groove 210*g* of the second magazine 210*m*. This is best seen in FIGS. 14A and 14B. Magazine 205*m* may have multiple grooves of varying lengths. As shown in FIGS. 14A and 14B, as the first magazine 205*m* is inserted into the first compartment 205, the first engaging member 220*e* engages the first magazine 205*m* along the first groove 205*g*. Once seated, the first magazine 205*m* is held substantially secure by not only the frictional forces of the first magazine 205*m* against its defining walls 230, 235, 240, 215*a*, and by the gravitational force of the first magazine 205*m* against the inner bottom surface 245 of the first compartment 205, but also by the spring force of the first tensioning member 220*t* pushing outward on the first engaging member 220*e* which in turn engages the first magazine 205*m* in the first groove 205*g*.

Preferably, the first retaining member 220*r* is a threaded cap-screw, the first tensioning member 220*t* is a spring, and the first engaging member 220*e* is a ball bearing. The ball bearing 220*e* is available from McMaster-Carr Supply Company of Los Angles, Calif., model number 302 stainless steel, part number 9291K23. The cap-screw 220*r* and spring 220*t* are available from Mercob Technologies/Mercob Security Guard Info, of Pasadena, Calif. First housing 220*h* is correspondingly threaded to receive the cap-screw 220*r*, and is sized to comfortably house the spring 220*t* and ball bearing 220*e*. The dimensions of the components of securing member 220 should be such that the ball bearing 220*e* should rest on the spring 220*t* without passing therethrough, and should be able to peek through the cap-screw 220*r* without passing therethrough. For example, the diameter of the ball bearing 220*e* may be approximately 0.25 inches to correspond to the width of the first groove 205*g* in the first magazine 205*m* which the ball bearing 220*e* will engage. In such a case, the inner diameter of the cap-screw 220*r* should be not more than 0.25 inches, and the inner diameter of the spring 220*t* should be not more than 0.25 inches.

Placement of the securing members 220, 225 is best seen in FIGS. 14A and 14B. FIG. 14A shows the securing members 220, 225 at substantially the same vertical height relative to the divider 215. FIG. 14B shows the first securing member 220 (and corresponding first maintenance hole 285) at a lower vertical height than the second securing member 225 (and corresponding second maintenance hole 300). As seen in FIGS. 14A and 14B, the first securing member 220 is secured in the first housing 220*h* by the first retaining member 220*r* such that the first tensioning member 220*t* forces a portion of the first engaging member 220*e* to extend into the first compartment 205 to engage the first groove 205*g*. Similarly, the second securing member 225 is secured in the second housing 225*h* by the second retaining member 225*r* such that the second tensioning member 225*t* forces a portion of the second engaging member 225*e* to extend into the second compartment 210 to engage the second groove 210*g*.

Figure 16:
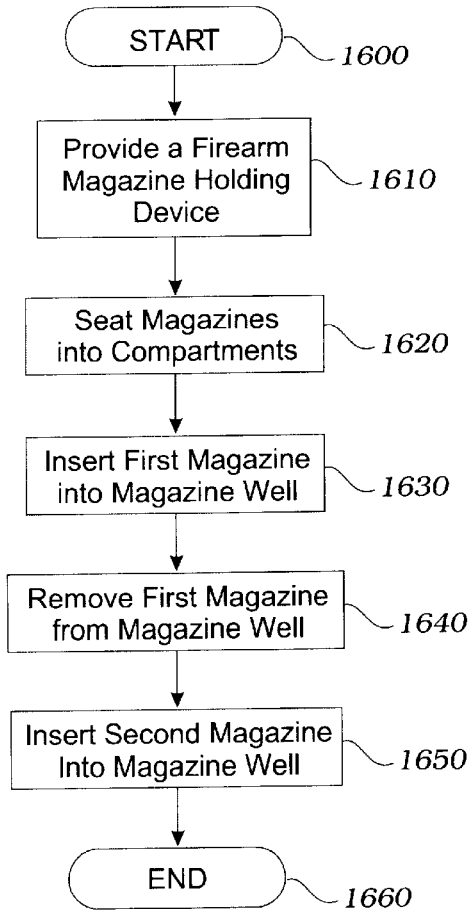
FIG. 16 is a flow chart illustrating a method of using the magazine holders of FIGS. 8–10 in accordance with the present invention.

Turning now to FIG. 16, a flow chart is shown illustrating a method of using the magazine holders of FIGS. 8–13. The process begins at step 1600. At step 1610, a firearm magazine holder as described herein is provided. A manufacturer, distributor, or other third party may supply the device. In this respect, "providing" the device is intended to refer to the fact that such a device is in fact present in use with the method, and so the device may be provided by the actual user thereof. If securing members are used, and are not yet installed, they may be installed at this point. A typical installation of a securing member such as described herein and shown in FIGS. 10, 14A, and 14B, would include placing the spring into its respective housing, placing the ball bearing in front of the spring, and then tightening or otherwise securing the retaining member to the housing. Though the retaining member is shown as being threaded into the housing in the Figures, the retaining member may be secured in place by other means such as by press-fitting or by an adhesive such as glue. Further, the retaining member need not be inserted/installed to the entire depth of the housing. It is sufficient that the retaining member is substantially flush with the side of the divider to which it is installed.

At step 1620, the first magazine is seated in the first compartment such that the first securing member engages the first magazine to assist in securing the first magazine into the first compartment. Typically, the first securing member engages the first magazine within a groove thereof. The second magazine is seated in the second compartment such that the second securing member engages the second magazine to assist in securing the second magazine into the second compartment. Typically, the second securing member engages the second magazine within a groove thereof. Typically, a magazine is seated by applying downward force thereto to move the magazine toward the bottom surface of its compartment. The magazine is thus seated when the magazine is substantially fully inserted into its respective compartment, such that the magazine rests on, engages, and/or is forced against the bottom surface of its respective compartment.

Once the magazines are properly seated, the first magazine is inserted into a magazine well at step 1630, and the entire unit (magazine holder with magazines seated therein) is then installed and operational. The first magazine remains seated in the first compartment after being inserted into the magazine well. Once the first magazine is expended, the first magazine may be removed from the magazine well (step 1640), and remains seated in the first compartment after being removed from the magazine well. Removal of the first magazine from the first magazine well may occur at any time, but typically this will occur only after the first magazine is expended. The second magazine may then be inserted into the magazine well (step 1650), and likewise remains seated in the second compartment after being inserted into the magazine well. If the magazine holder holds more than two magazines, the process may continue for each such additional magazine. A magazine may be removed from the magazine holder by pulling on the magazine with sufficient force to overcome the frictional forces of the compartment against the magazine, and the spring force of the tensioning member. The process ends at step 1660.

While certain embodiments are illustrated in the drawings and are described herein, including preferred embodiments, it will be apparent to those skilled in the art that the specific embodiments described herein may be modified without departing from the inventive concepts described. For example, the plates of the embodiment shown in FIGS. 2–4 may be machined, stamped, or manufactured using various well-known methods. Additionally, the device may be used with firearm replicas, dummy training firearms (demonstration, classes, display), F.A.T.S. machine weaponries, movie props, and live simmunition weapons (commonly used by both military and law enforcement personnel. Also, the outer edge surfaces of the upper and/or lower plates of the embodiment shown in FIGS. 2–4 may be chamfered and/or curved, independent of each other.

What is claimed is:

1. A device for holding a plurality of magazines for use with a firearm comprising:

a single-piece body having a first compartment adapted to receive a first magazine, and a second compartment adapted to receive a second magazine, the first compartment and the second compartment being separated by a divider having a first side wall and a second side wall;

a first securing member located within a first housing of the divider; and a second securing member located within a second housing of the divider;

wherein the first securing member is adapted to engage the first magazine when the first magazine is seated in the first compartment; and wherein the second securing member is adapted to engage the second magazine when the second magazine is seated in the second compartment.

2. The device of claim 1, wherein the first securing member is adapted to engage the first magazine within a first groove of the first magazine when the first magazine is seated in the first compartment, and the second securing member is adapted to engage the second magazine within a second groove of the second magazine when the second magazine is seated in the second compartment.

3. The device of claim 2, wherein the first securing member comprises a first tensioning member, a first engaging member, and a first retaining member, and the first securing member is secured in the first housing by the first retaining member such that the first tensioning member forces a portion of the first engaging member to extend into the first compartment to engage the first groove; and wherein the second securing member comprises a second tensioning member, a second engaging member, and a second retaining member, and the second securing member is secured in the second housing by the second retaining member such that the second tensioning member forces a portion of the second engaging member to extend into the second compartment to engage the second groove.

4. The device of claim 2, wherein the first retaining member is a threaded cap-screw, and the second retaining member is a threaded cap-screw.

5. The device of claim 2, wherein the first engaging member is a ball bearing, and the second engaging member is a ball bearing.

6. The device of claim 1, wherein the single-piece body has a first maintenance hole and a second maintenance hole, and wherein the first maintenance hole allows access to the first securing member through the first compartment and is sized to allow the first securing member to pass therethrough, and wherein the second maintenance hole allows access to the second securing member through the second compartment and is sized to allow the second securing member to pass therethrough.

7. The device of claim 6, wherein the first maintenance hole is in a first exterior side wall of the single-piece body, and wherein the second maintenance hole is in a second exterior side wall of the single-piece body.

8. The device of claim 1, wherein the single-piece body comprises ultra high molecular weight (UHMW) polyethylene.

9. The device of claim 1, wherein the single-piece body has an irrigation hole in a bottom surface thereof.

10. The device of claim 1, wherein the single-piece body has an anti-slip surface.

11. The device of claim 1, wherein the first compartment is defined by a back wall, a front wall, a side wall, the first side wall of the divider, and an inner bottom surface; the second compartment is defined by a back wall, a front wall, a side wall, the second side wall of the divider, and an inner bottom surface; and wherein the front wall of the first compartment extends to the inner bottom surface of the first compartment, and the front wall of the second compartment extends to the inner bottom surface of the second compartment.

12. The device of claim 1, wherein the first compartment is defined by a back wall, a front wall, a side wall, the first side wall of the divider, and an inner bottom surface; the second compartment is defined by a back wall, a front wall, a side wall, the second side wall of the divider, and an inner bottom surface; and wherein the front wall of the first compartment and the front wall of the second compartment are substantially coplanar.

13. The device of claim 1, wherein the first compartment is defined by a back wall, a front wall, a side wall, the first side wall of the divider, and an inner bottom surface; the second compartment is defined by a back wall, a front wall, a side wall, the second side wall of the divider, and an inner bottom surface; and wherein the front wall of the second compartment extends upward to a different vertical height than does the back wall of the second compartment.

14. The device of claim 13, wherein the front wall of the first compartment extends upward to a different vertical height than does the back wall of the first compartment.

15. The device of claim 1, wherein the first securing member is at a lower vertical height than is the second securing member.

16. The device of claim 1, wherein the first compartment is defined by a back wall, a front wall, a side wall, the first side wall of the divider, and an inner bottom surface; the second compartment is defined by a back wall, a front wall, a side wall, the second side wall of the divider, and an inner bottom surface; and wherein the inner bottom surface of the first compartment and the inner bottom surface of the second compartment are in substantially parallel planes.

17. A device for holding a plurality of magazines for use with a firearm comprising:

a single-piece body having a first compartment adapted to snugly receive a first magazine, and a second compartment adapted to snugly receive a second magazine, the first compartment and the second compartment being separated by a divider having a first side wall and a second side wall;

wherein the first compartment is defined by a back wall, a front wall, a side wall, the first side wall of the divider, and an inner bottom surface;

wherein the second compartment is defined by a back wall, a front wall, a side wall, the second side wall of the divider, and an inner bottom surface;

wherein the front wall of the first compartment extends to the inner bottom surface of the first compartment;

wherein the front wall of the second compartment extends to the inner bottom surface of the second compartment; and further comprising a first securing member located within a first housing of the divider and adapted to engage the first magazine when the first magazine is seated in the first compartment; and a second securing member located within a second housing of the divider and adapted to engage the second magazine when the second magazine is seated in the second compartment.

18. A device for holding a plurality of magazines for use with a firearm comprising:

a single-piece body having a first compartment adapted to snugly receive a first magazine, and a second compartment adapted to snugly receive a second magazine, the first compartment and the second compartment being separated by a divider having a first side wall and a second side wall;

wherein the first compartment is defined by a back wall, a front wall, a side wall, the first side wall of the divider, and an inner bottom surface;

wherein the second compartment is defined by a back wall, a front wall, a side wall, the second side wall of the divider, and an inner bottom surface;

wherein the front wall of the first compartment extends to the inner bottom surface of the first compartment;

wherein the front wall of the second compartment extends to the inner bottom surface of the second compartment; and wherein the front wall of the second compartment extends upward to a different vertical height than does the back wall of the second compartment.

19. A device for holding a plurality of magazines for use with a firearm comprising:

a single-piece body having a first compartment adapted to snugly receive a first magazine, and a second compartment adapted to snugly receive a second magazine, the first compartment and the second compartment being separated by a divider having a first side wall and a second side wall;

wherein the first compartment is defined by a back wall, a front wall, a side wall, the first side wall of the divider, and an inner bottom surface;

wherein the second compartment is defined by a back wall, a front wall, a side wall, the second side wall of the divider, and an inner bottom surface;

wherein the front wall of the first compartment extends to the inner bottom surface of the first compartment;

wherein the front wall of the second compartment extends to the inner bottom surface of the second compartment; and wherein the front wall of the first compartment extends upward to a different vertical height than does the back wall of the first compartment.

20. A method for holding a plurality of magazines in a device for use with a firearm, comprising the steps:

providing a firearm magazine holder comprising a single-piece body having a first compartment adapted to receive a first magazine, and a second compartment adapted to receive a second magazine, the first compartment and the second compartment being separated by a divider; a first securing member located within a first housing of the divider; and a second securing member located within a second housing of the divider; wherein the first securing member is adapted to engage the first magazine when the first magazine is seated in the first compartment; and wherein the second securing member is adapted to engage the second magazine when the second magazine is seated in the second compartment;

seating the first magazine in the first compartment such that the first securing member engages the first magazine to assist in securing the first magazine into the first compartment; and seating the second magazine in the second compartment such that the second securing member engages the second magazine to assist in securing the second magazine into the second compartment.

21. The method of claim 20, further comprising the step of inserting the first magazine into a magazine well of the firearm, the first magazine remaining seated in the first compartment after being inserted into the magazine well.

22. The method of claim 20, further comprising the steps of removing the first magazine from the magazine well of the firearm, the first magazine remaining seated in the first compartment after being removed from the magazine well; and inserting the second magazine into the magazine well of the firearm, the second magazine remaining seated in the second compartment after being inserted into the magazine well.

23. The method of claim 20, wherein the first securing member is adapted to engage the first magazine within a groove of the first magazine when the first magazine is seated in the first compartment, and wherein the second securing member is adapted to engage the second magazine within a groove of the second magazine when the second magazine is seated in the second compartment.

* * * * *